US005440795A

United States Patent [19]

Chon et al.

[11] Patent Number: 5,440,795

[45] Date of Patent: Aug. 15, 1995

[54] HAMMER FOR USE IN SHREDDERS HAVING REPLACEABLE PIN HOLES

[75] Inventors: David N. Chon, Baltimore, Md.; Andrew V. Maynard, West Palm Beach, Fla.

[73] Assignee: The Babcock & Wilcox Company, New Orleans, La.

[21] Appl. No.: 359,133

[22] Filed: Dec. 19, 1994

Related U.S. Application Data

[62] Division of Ser. No. 74,510, Jun. 11, 1993, Pat. No. 5,381,975.

[51] Int. Cl.[6] ..... B02C 13/28

[52] U.S. Cl. ..... 29/401.1; 29/402.08; 29/525.1

[58] Field of Search ..... 29/401.1, 426.1, 402.08, 29/428, 525.1; 241/195, 197, 291, 292.1, 300

[56] References Cited

U.S. PATENT DOCUMENTS

| | | | |
|---|---|---|---|
| 2,994,486 | 8/1961 | Trudeau | 241/197 |
| 3,503,562 | 3/1970 | Haberman | 241/195 |
| 4,129,262 | 12/1978 | Lowry | 241/197 |
| 4,619,029 | 10/1986 | Newell et al. | 29/402.05 |
| 4,985,976 | 1/1991 | Titmas et al. | 29/402.08 |
| 5,005,772 | 4/1991 | Ostergaard | 241/30 |
| 5,111,569 | 5/1992 | Ostergaard | 29/407 |
| 5,381,975 | 1/1995 | Chon et al. | 241/195 |

*Primary Examiner*—Irene Cuda
*Assistant Examiner*—John M. Husar
*Attorney, Agent, or Firm*—Robert J. Edwards

[57] ABSTRACT

The pin holes for hammers used in shredders can be changed without the need for removing the hammer pins. A single elliptical hammer pin slot is provided in the hammer. A hammer pin is inserted into one end of the elliptical hammer pin slot and a removable plug is inserted into the slot at the hammer pin thereby securing the pin to the hammer. The pin hole can be changed upon normal wear and tear by removing the plug and sliding the hammer to move the pin to the opposite pin hole at the opposite curved section of the elliptical pin slot. The plug is reinserted at the opposite pin hole thereby securing the pin to the hammer.

6 Claims, 2 Drawing Sheets

FIG. 3
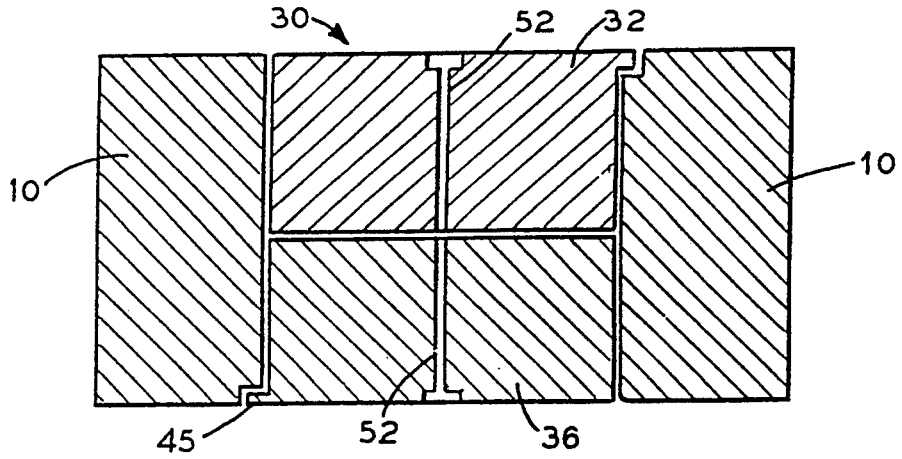
FIG. 4
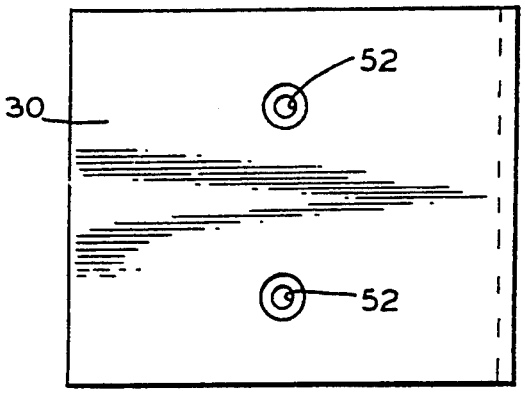
FIG. 5
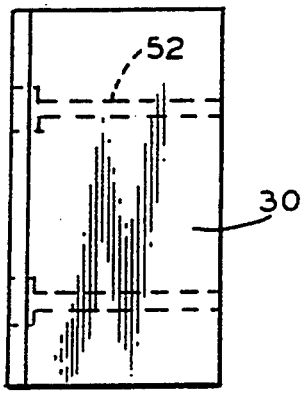
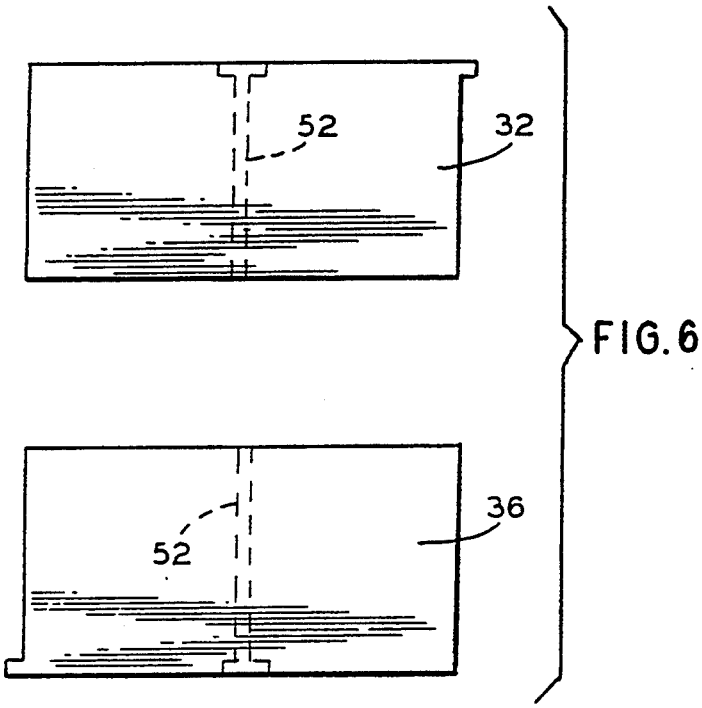
FIG. 6

HAMMER FOR USE IN SHREDDERS HAVING REPLACEABLE PIN HOLES

This application is a division of application Ser. No. 08/074,510, filed Jun. 11, 1993 now U.S. Pat. No. 5,381,975.

FIELD AND BACKGROUND OF THE INVENTION

The present invention relates, in general, to shredder hammers and, more particularly, to a new and useful hammer which provides for the changing of pin holes without the removal of the hammer pins.

Shredders are used in a variety of different industrial applications. Typically, a shredder includes an enclosed rotor and hammers that are attached to the rotor by hammer pins. The rotor is spun at a high rate of speed by either an electric motor or diesel engine drive. Material is fed into the enclosed shredder and is impacted by the heavy high speed hammers thereby reducing the particle size of the feed material. Through continued use of the shredder equipment, the hammers will wear out and require either a change of hammer pin holes or a replacement of the hammers. In the common method used to change hammer pin holes or to replace a hammer, it is necessary to remove the hammer pins. However, the removal of hammer pins, for the replacement of hammer pin holes or the hammer itself, is costly and inefficient and has led to the development of replaceable tip hammers as disclosed in U.S. Pat. No. 3,829,032.

Two common types of hammers are used in shredders. These are hammers having two sides, commonly known as a bell type hammer, and hammers having four sides, commonly known as a bow-tie type hammer. Replaceable tip hammers are used in conjunction with the two-sided bell type hammers. However the bow-tie hammer, with its four useable sides, has become the preferred type hammer in the solid waste processing field, even though no method or device is known that allows for the changing or replacing of hammer pin holes without removal of the hammer pins.

SUMMARY OF THE INVENTION

The present invention concerns a hammer for use in a shredder that allows the changing of the pin holes of the hammer without removal of the hammer pins. This is achieved by replacing the existing hammer pin holes with a single elongated, oval or elliptical-shaped, hammer pin slot in the hammer. A removable plug is inserted at one end of the slot to secure the hammer pin to the hammer. The plug can also be of the two-piece type. When it is necessary to change hammer pin holes, the change can easily be achieved by removing the plug, sliding the hammer so that the hammer pin is moved to the opposite end of the oval pin hole slot, and reinstalling the plug at the other end of the slot. Accordingly, the need to remove the hammer pins is eliminated. The present invention is applicable to bow-tie type hammers as well as to all other types of shredder hammers, regardless of shape, utilizing two hammer pin holes.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which the preferred embodiments of the invention are illustrated.

BRIEF DESCRIPTION OF THE DRAWINGS

In the drawings:

FIG. 3 is a cross sectional view of the hammer and plug taken along line 3—3 of FIG. 2;

FIG. 4 is a top plan view of an alternate embodiment of the plug;

FIG. 5 is a side elevation view of the plug of FIG. 4; and

FIG. 6 is a perspective view of the plug of FIG. 2.

DESCRIPTION OF THE PREFERRED EMBODIMENTS

Figure 1:
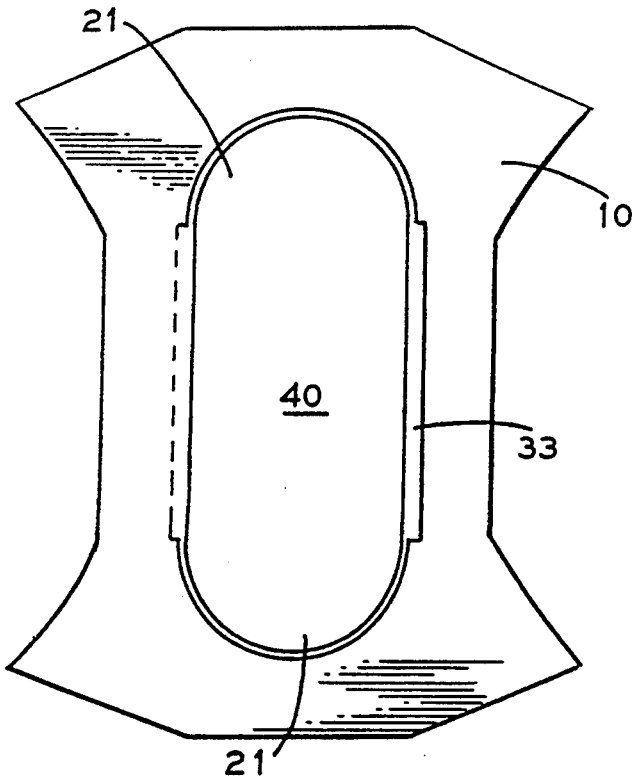
FIG. 1 is a top plan view of a hammer having an elliptical pin slot embodying the present invention.

Referring to FIG. 1, there is shown a hammer 10 for use in a shredder constructed so that the pin hole 21 of the hammer 10 may be changed without replacing the hammer pins. The hammer 10 has an elliptical slot 40. A lip 33 is provided on the periphery of the elliptical slot 40 for receiving a removable plug 30, as shown in FIG. 2.

Figure 2:
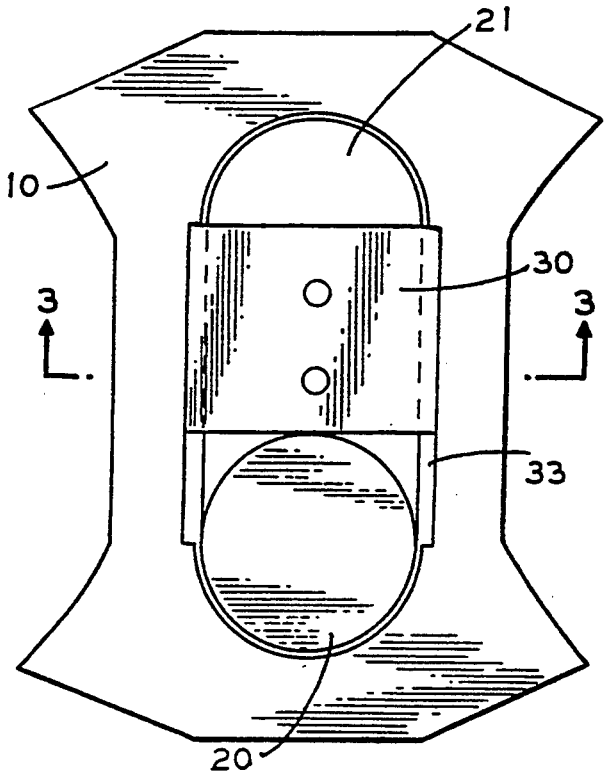
FIG. 2 is a top plan view of a hammer fitted with a pin and a plug.

FIG. 2 illustrates the elliptical slot 40 divided into two pin locations or pin holes 21 located at each end or curved section of the slot 40. A hammer pin 20 is positioned within one of the pin holes 21. The plug 30 is inserted into the hammer 10 adjacent to the outer circumferential surface of the pin 20 and rests against the lip 33 formed along the periphery of the elliptical slot 40. The pin hole 21 opposite the pin 20 serves as an alternate pin location. When it becomes necessary to change the pin hole 21, the removable plug 30 is withdrawn from the hammer 10 and the latter is moved such that the pin 20 slides into the alternate pin location or pin hole 21 and the removable plug 30 is reinserted back into the hammer 10 to secure the pin 20 to the hammer. Thus, it can be seen that the hammer pin 20 does not need to be removed from the hammer 10 when it is relocated to the alternate pin hole 21.

The removable plug 30 may consist of different type designs. In one design, the plug 30 has a first section 32 and a second section 36 joined together within the hammer 10 as shown in FIG. 3. The plug 30 can be provided with a flange 45 which will come to rest on the lip 33 shown in FIG. 1. Additionally, a plug securing means 52, such as a hole adapted to receive a fastener, not shown, can be used in cooperation with the fastener to secure the first section 32 and the second section 36 to each other and within the hammer 10.

FIG. 4 and FIG. 5 illustrate an alternate embodiment of the plug 30 which includes two plug securing means 52, each adapted to receiving a fastener, not shown.

FIG. 6 shows that the first section 32 and the second section 36 can be joined and aligned by the plug securing means 52.

The present invention advantageously minimizes equipment downtime necessary to change hammer pin holes, reduces the labor cost associated with the changing of pin holes, and allows an operator the option of changing pin holes for only those hammers that are severely worn thereby prolonging the life of partially worn hammers that are not yet in need of changing.

It is generally common practice, when using the standard method of removing hammer pins for the changing of pin holes, to change the pin holes for all hammers at the same time. The high labor cost and extended equipment downtime needed for changing hammers using this practice does not justify changing only some of the hammers. However, with the present invention it is possible to maximize the life of a hammer with minimum labor cost and equipment downtime by changing the pin holes of only fully worn hammers.

While the specific embodiments of the invention have been shown and described in detail to illustrate the application of the principles of the invention, it will be understood that the invention may be embodied otherwise without departing from such principles.

What is claimed is:

1. A method for changing pin holes of a hammer used in a shredder, the method comprising:

providing a single aperture having a plurality of pin receiving locations in the hammer for replacing the pin holes of the hammer;

inserting a pin in the aperture at one of the pin receiving locations for securing the hammer to the shredder;

inserting a removable plug in the hammer at the pin for securing the pin within the pin receiving location;

removing the plug from the hammer when seeking to change the pin receiving location;

locating the pin at an alternate pin receiving location; and reinserting the plug in the hammer at the pin for securing the pin to the alternate pin receiving location.

2. The method according to claim 1, wherein the single aperture is an elongated elliptical aperture.

3. The method according to claim 2, wherein the pin receiving locations are located at each end of the elliptical aperture.

4. The method according to claim 1, wherein the single aperture has a lip provided at the aperture for engaging the plug.

5. The method according to claim 4, wherein the plug has a flange for engaging the lip of the hammer.

6. The method according to claim 1, wherein the hammer is slidably moved such that the pin is repositioned at the alternate pin receiving location.

* * * * *